United States Patent [19]

Boyd

[11] 4,312,097

[45] Jan. 26, 1982

[54] COUNTERBALANCE SUPPORT

[75] Inventor: Kenneth J. Boyd, E. Randolph, N.Y.

[73] Assignee: Weber-Knapp Company, Jamestown, N.Y.

[21] Appl. No.: 124,797

[22] Filed: Feb. 26, 1980

[51] Int. Cl.[3] ..... E05F 3/04; E05F 3/20

[52] U.S. Cl. ..... 16/279; 16/289

[58] Field of Search ..... 16/54, 55, 66, 68, 72, 16/80, 85, 180, 190, 84

[56] References Cited

U.S. PATENT DOCUMENTS

| | | | |
|---|---|---|---|
| 1,693,860 | 12/1928 | Olson | 16/85 |
| 3,496,595 | 2/1970 | Larson | 16/180 |
| 3,562,848 | 2/1971 | Czapar | 16/55 |
| 3,771,194 | 11/1973 | Little | 16/190 |
| 4,015,309 | 4/1977 | Gronbach | 16/85 X |
| 4,034,438 | 7/1977 | Csokasy et al. | 16/85 |
| 4,091,502 | 5/1978 | Little | 16/85 X |

*Primary Examiner*—Wm. Carter Reynolds

*Attorney, Agent, or Firm*—Bean, Kauffman & Bean

[57] ABSTRACT

A counterbalance support for hingedly mounting a cover on a cabinet for vertical swinging movements between horizontally disposed closed and vertically disposed open positions, which features an arrangement for maintaining a counterbalance spring device in a deactivated condition permitting non-counterbalanced pivotal movements of hinge parts of the support, as an incident to mounting the cover on the cabinet.

7 Claims, 6 Drawing Figures

COUNTERBALANCE SUPPORT

BACKGROUND OF THE INVENTION

In U.S. Pat. No. 3,771,194 there is disclosed an improved construction for permitting a cover mounting hinge and counterbalance mechanism of the type disclosed in U.S. Pat. No. 3,187,374 to be installed for purposes of mounting a cover on a cabinet without necessitating adjustment of a counterbalance spring device. More specifically, U.S. Pat. No. 3,771,194 contemplates the utilization of a retainer adapted to be inserted in the mechanism in a manner providing for precompression of a counterbalance spring device sufficient to permit the cover and cabinet hinge parts to undergo free or noncounterbalance movements during installation of the mechanism. After installation, the retainer is removed to permit the compression spring device to become effective for counterbalance purposes.

A retainer device of the type contemplated by U.S. Pat. No. 3,771,194 is, however, not readily adapted for use in more basic counterbalance supports of the type employing a counterbalance spring device whose opposite ends are directly connected to a pair of hinge parts by pivot devices, such as that disclosed for instance in U.S. Pat. Nos. 2,257,791 and 3,330,593 (FIG. 3).

SUMMARY OF THE INVENTION

The present invention is directed towards an improved counterbalance support and method of mounting same. More particularly, the present invention is directed towards an arrangement adapted to selectively maintain a counterbalance spring device of the type having its opposite ends directly connected to a pair of hinge parts in a deactivated condition in order to permit non-counterbalanced relative pivotal movements of the hinge parts incident to the mounting of a cover on a cabinet.

DRAWINGS

The nature and mode of operation of the present invention will now be more fully described in the following detailed description taken with the accompanying drawings wherein.

Figure 4:
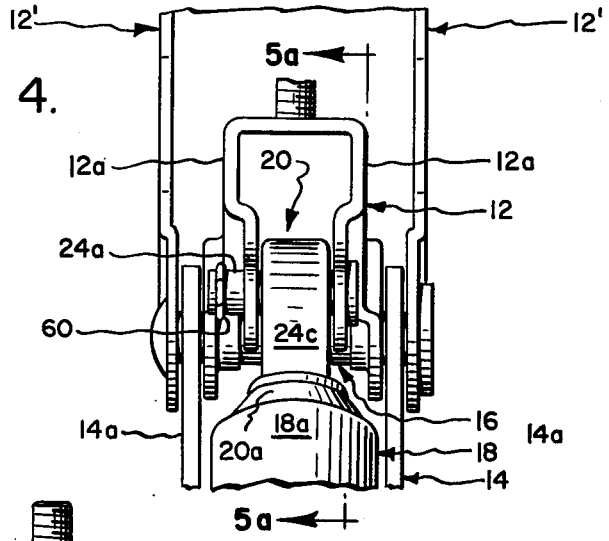
FIG. 4 is a sectional view taken generally along the line 4—4 in FIG. 1.
Figure 5A:
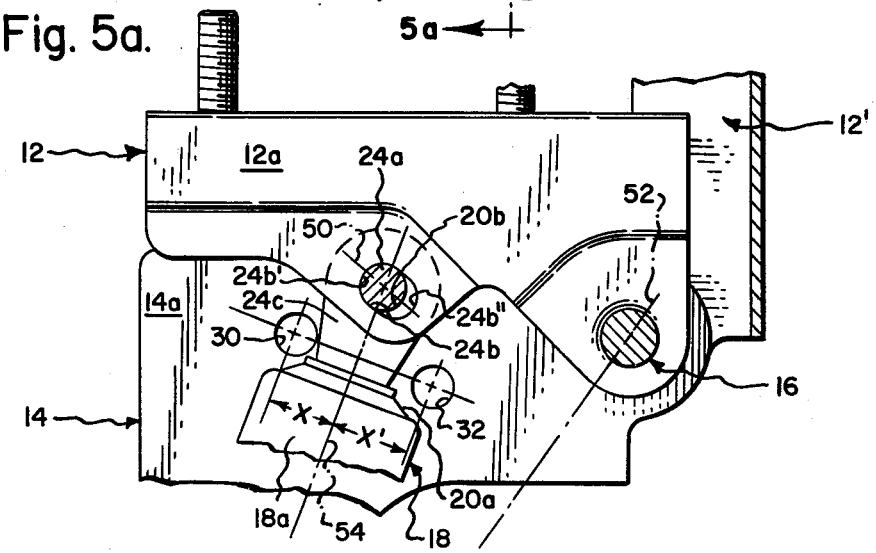
Figure 5B:
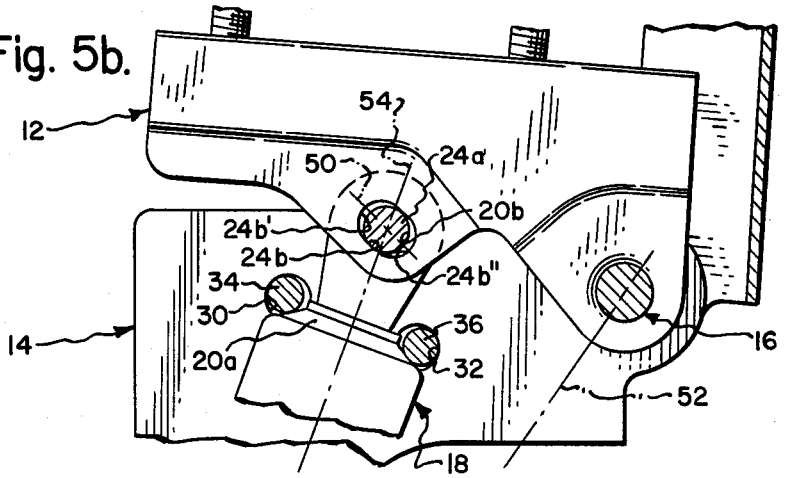

FIG. 5*a* is a sectional view taken generally along the line 5*a* in FIG. 4; and FIG. 5*b* is a view similar to FIG. 5*a*, but with the counterbalance spring device in deactivated condition.

DETAILED DESCRIPTION

Figure 1:
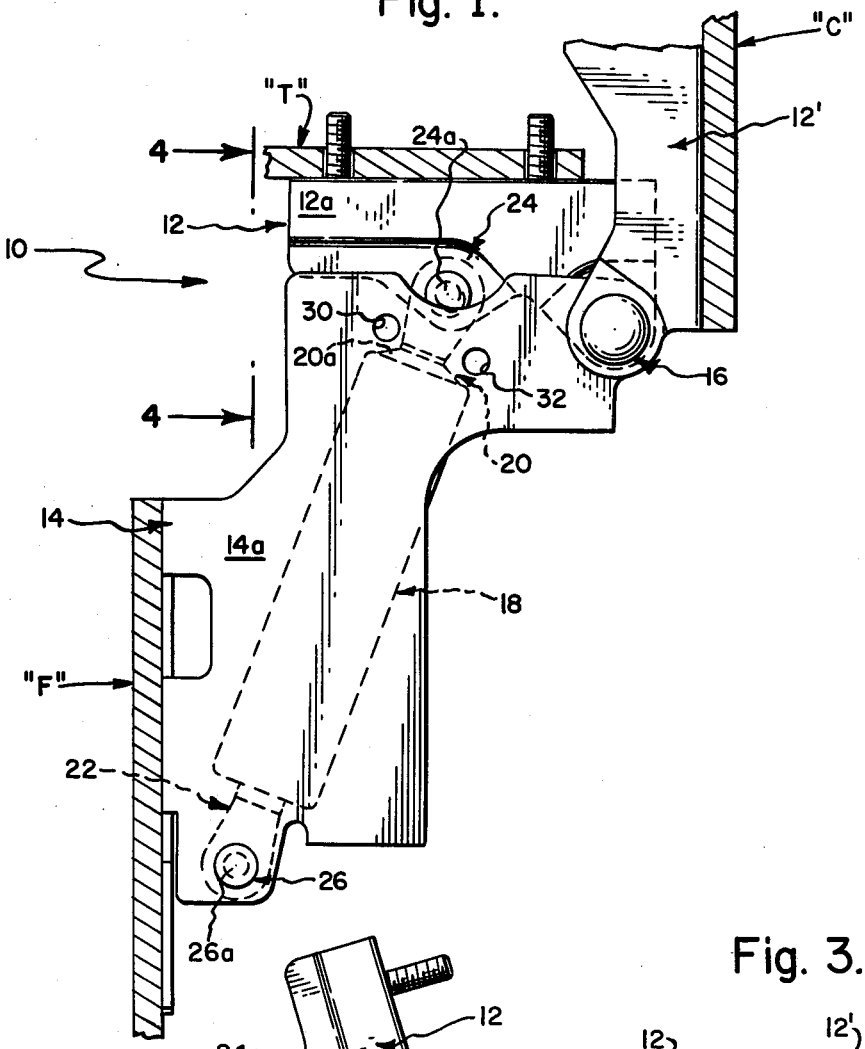
FIG. 1 is a side elevational view of a counterbalance support showing its hinge parts in closed position.
Figure 2:
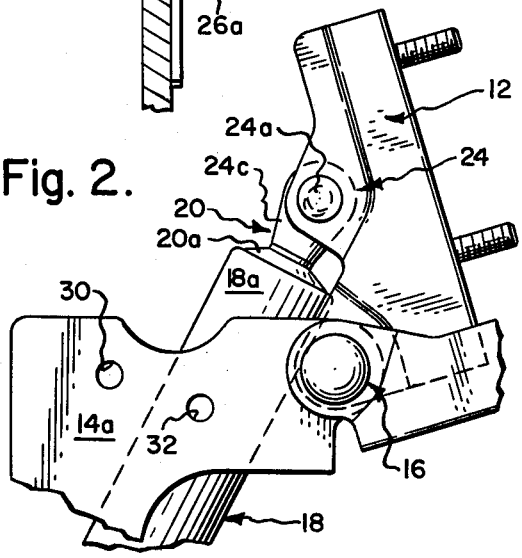
FIG. 2 is a fragmentary side elevational view of the support with the hinge parts in open position.
Figure 3:
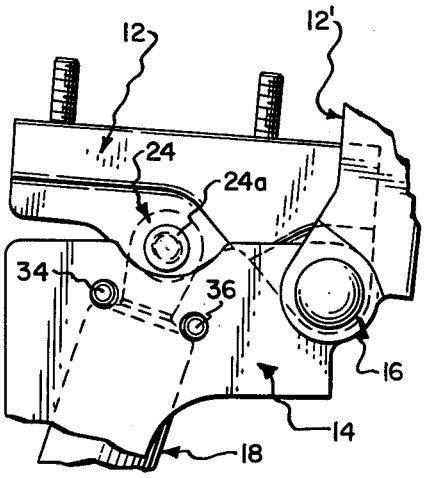
FIG. 3 is a fragmentary side elevational view of the support showing the counterbalance spring device in deactivated condition.

Reference is first made to FIGS. 1–3, wherein a counterbalance support employing the present invention is generally designated as 10 and shown as including first and second hinge parts or brackets 12 and 14; hinge pin means 16 for connecting the hinge parts 12 and 14 for relative pivotal movements; a counterbalance spring device 18 having first and second ends 20 and 22; and first and second pivot means 24 and 26 for connecting first and second ends 20 and 22 for pivotal movements relative to hinge parts 12 and 14, respectively. The pivot axes defined by first and second pivot means 24 and 26 are parallel to the pivot axis of hinge pin 16.

The support illustrated in the drawings is intended to mount a device known as a "transport" and a protective cover therefor, which are designated as "T" and "C", respectively, in FIG. 1 for vertical swinging movements relative to a cabinet frame, which is designated as "F" in FIG. 1, between closed and open positions corresponding to the closed and open positions of hinge part 12 shown in FIGS. 1 and 2, respectively. To this end, first and second hinge parts 12 and 14, which may be considered the movable and stationary hinge parts, are suitably fixed to the "transport" and cabinet frame, respectively, and an additional movable hinge part 12' is provided for mounting the protective cover. Additional hinge part 12' may be mounted by hinge pin 16 for swinging movements relative to hinge part 14 independently of hinge part 12 to facilitate installation of support 10 on the cabinet, but preferably, means, not shown, are provided thereafter to lock together hinge parts 12 and 12' for conjunctive swinging movements between closed and open positions. In this type of installation, counterbalance spring device 18 is operative to produce a force or bias, which acts lengthwise of the spring device through first pivot means 24 to produce a moment directed clockwise about the axis of hinge pin 16, as viewed in FIGS. 1, 2 and 3, serving to counterbalance at least in part the torque effects of gravity acting on both of hinge parts 12 and 12' and their associated "transport" and protective cover.

It will be understood that the invention to be hereinafter described is not limited in use to a support having hinge parts of the specific configuration illustrated in the drawings; to a support provided with an additional hinge part; to the type of load to be supported by the movable hinge part; or to the type of base on which the stationary hinge part is to be mounted. Thus, for the purpose of convenience in terminology, the term "cover" will be considered to include any load desired to be counterbalanced as an incident to vertical swinging movements thereof between an essentially horizontally disposed or "closed" position and an essentially vertically disposed or "open" position; and the term "cabinet" will be considered to include any base on which such "cover" is intended to be mounted by support 10. The open and closed positions of the cover may be determined, as desired, by stops or abutments formed as an integral part of the support and/or a part of the cover and the cabinet. Alternatively, the open position of the cover may, if desired, correspond with a fully extended or expanded condition of counterbalance spring device 18 shown in FIG. 2, which is determined by the construction of such spring device.

Also, it will be understood that the present invention is not limited in use to a support employing a counterbalance spring device in the form of the commercially available gas filled pressure cylinder of the type illustrated in the drawings, which may be referred to as a "gas spring". Rather, support 10 may be fitted with any suitable counterbalance spring device so long as the opposite ends of such a device include first end 20 having an end surface suitably contoured to define a cam or bearing surface 20*a* and a bearing opening 20*b* sized to receive a first pivot pin 24*a* forming a part of first pivot means 24; and second end 22, which is formed in a manner permitting same to be attached to hinge part 14 by second pivot means 26, such as for example, may be defined by a second pivot pin 26*a* fitted within aligned bearing openings, not shown, formed in second end 22 and hinge part 14. In the case of a conventional pressure cylinder of the type illustrated in the drawings, cam surface 20*a* may be conveniently defined in part by weld or other material employed to join the cylindrical housing 18*a* of the pressure cylinder to the end fitting 24*c* in which bearing opening 20*b* is disposed. An example of a conventional alternative counterbalance spring device adapted for use in support 10 would be one having a coil type compression spring disposed about a rod for opposite end bearing engagement with a bearing plate fixed adjacent an upper end of such a rod and a suitable second pivot means serving to both pivotally and slidably support a lower end of such rod relative to hinge part 14. In this alternative construction, the upper end of the rod would normally be apertured to receive first pivot pin 24*a* and the bearing plate shaped to define cam surface 20*a*.

In accordance with the present invention, the conventional support 10 is modified to permit counterbalance spring device 18 to be selectively maintained in a deactivated state, as best shown in FIGS. 3 and 5*b*, so as to permit non-counterbalance pivotal movements of hinge part 12, as an incident to mounting of a cover on a cabinet. More specifically, the present invention contemplates modification of otherwise conventional first pivot means 24 by providing each of leg flanges 12*a*, 12*a* of hinge part 12 with an elongated or enlarged bearing opening 24*b* in place of a circular or bore opening, which would normally be employed for receiving pivot pin 24*a* of a conventional coupling arrangement and the provision in each of the leg flanges 14*a*, 14*a* of hinge part 14 with first and second openings 30 and 32 sized to removably receive the ends of a pair of retaining pins 34 and 36, respectively.

By reference to FIGS. 5*a* and 5*b*, it will be understood that enlarged bearing opening 24*b* is characterized as having bearing end portion 24*b*′ and a remote end portion 24*b*″, which is spaced from the bearing end portion through a distance sufficient to permit displacement of pivot pin 24*a* from engagement with such bearing end portion. Further by reference to FIG. 5*a*, it will be understood that enlarged bearing opening 24*b* is positioned in hinge part 12 such that the spring force exerted by counterbalance spring device 18 tends to move pivot pin 24*a* within the enlarged bearing opening as required to normally maintain the pivot pin in bearing engagement with bearing end portion 24*b*′.

In the illustrated form of the present invention, enlarged bearing portion opening 24*b* is positioned such that end portions 24*b*′ and 24*b*″ are disposed relatively remotely from and adjacent to hinge pin 16, respectively, with a line 50, which is drawn lengthwise of the enlarged bearing opening, being arranged to intersect with a center line 54 of spring device 18, which in turn is drawn between the axes of pivot pins 24*a* and 24*b*, at an angle other than 90° when hinge part 12 is in its closed condition to insure normal maintenance of pivot pin 24*a* in bearing engagement with end portion 24*b*′ in the manner mentioned above. Also, in the illustrated form of the invention, first and second openings 30 and 32 are positioned such that the distance X, as measured between the center of opening 30 and center line 54 of spring device 18, is less than the distance X′, as measured between center line 54 and the center of opening 32, when the spring device is disposed essentially in its fully compressed or contracted condition shown in FIG. 5*a* as corresponding to the closed condition of hinge part 12; and cam surface 20*a* is shaped to have a generally convex configuration, that is, arranged to slope or incline upwardly and inwardly towards bearing opening 20*b*.

The procedure for assembling support 10, inserting retaining pins 34 and 36 for the purpose of deactivating spring device 18 and subsequently removing same to return the spring device to operable condition will now be described with particular reference to FIGS. 1, 2, 5*a* and 5*b*.

At a point of manufacture, spring device 18, while in its fully extended condition such as that shown in FIG. 2, would first have its second or lower end 22 fixed to hinge part 14 by assembling second pivot means 26 and then have its first or upper end 20 connected to hinge part 12 by insertion of pivot pin 24*a* through bearing openings 20*b* and 24*b*, while hinge part 12 is disposed in its open position; alignment of pivot pin 24*a* with its bearing openings being facilitated by pivotal adjustments of hinge part 12 about the axis of hinge pin 16 and of spring device 18 about the pivot axis of second pivot means 26. The support would then be placed in a suitable jig, not shown, and a closing force applied to hinge part 12 sufficient to move same against the bias of spring device 18 into its closed position shown in FIG. 1, wherein cam surface 20*a* of the spring device is disposed as a level slightly below and intermediate first and second openings 30 and 32 in the manner best shown in FIG. 5*a*. After insertion of retaining pins 34 and 36, the closing force is removed from hinge part 12 in order to permit spring device 18 to expand and thus move cam surface 20*a* upwardly towards the retaining pins. Due to the illustrated relative positioning of the first and second openings 30 and 32 and the configuration of cam surface 20*a*, the successively engage retaining pins 34 and 36; that is, the cam surface will first be forced into engagement with retaining pin 34, which then serves to "cam" spring device 18 or force same to move to the right, i.e., relatively towards hinge pin 16, as viewed in FIGS. 5*a* and 5*b*, until the cam surface engages with retaining pin 36, whereupon further movement/expansion of the spring device is arrested, as best shown in FIG. 5*b*. The above described successive engagement of the retaining pins by the cam surface and resultant camming movement of the spring device 18 serves to remove pivot pin 24*a* from bearing engagement with the bearing end portion 24*b*′, thereby freeing pivot pin 24*a* from load and permitting same to be removed from within bearing openings 20*b* and 24*b*, which in turn frees hinge part 12 for non-counterbalanced swinging movements relative to hinge part 14, as required for support mounting purposes.

After support 10 has been installed with the hinge part 14 fixed to the cabinet and hinge part 12 fixed to the cover, pivot pin 24*a* is reinstalled in the support by a procedure involving the lifting of the cover and thus hinge part 12 until the bearing opening 24*b* is again aligned with bearing opening 20*b*, as shown in FIG. 5*b*, and then inserting the pivot pin within the aligned bearing openings to again operably couple spring device 18 to hinge part 12. Any suitable means may be employed to retain hinge pin 24*a* in assembled condition, such as a snap ring 60 shown only in FIG. 4. Thereafter, the cover and hinge part 12 are permitted to fall under the influence of gravity or, if required, manually forced downwardly into fully closed position, as shown in FIGS. 1 and 5*a*, in order to return spring device 18 to its fully compressed state and remove or lower cam surface 20*a* from bearing engagement with retaining pins 34 and 36. As an incident to removal of cam surface 20*a* from engagement with pins 34 and 36, pivot pin 24*a* is freed to automatically move under the bias of spring device 18 within bearing opening 24*b* for return to bearing engagement with bearing end portion 24*b*′, as best shown in FIG. 5*a*. Retaining pins 34 and 36 are then removed in order to free the support for normal operation, during which time pivot pin 24*a* is continuously maintained in bearing engagement with bearing end portion 24*b*′ by the bias or counterbalance force exerted by spring device 18.

It is anticipated that in an alternative construction the position of enlarged bearing opening 24*b* could be changed such that remote end portion 24*b*″ is disposed downwardly and to the left of bearing end portion 24*b*′, as viewed in FIG. 5*a*, such that end portions 24*b*′ and 24*b*″ are disposed relative adjacent to and remotely from hinge pin 16, respectively. For this arrangement, the placement of first and second openings 30 and 32 would be changed such that the distance X exceeds the distance X′, whereby to permit retaining pin 36 to perform a camming function. Also, it will be understood that for either of the described positions of enlarged bearing opening 24*b*, the corresponding portion of first and second openings 30 and 32 may be reversed by changing the shape of cam surface 20*a* to assume a generally concave or V-shaped configuration, that is, arranged to slope or incline downwardly and inwardly relative to bearing opening 20*b*.

I claim:

1. In a combination hinge and counterbalance mechanism for hingedly mounting a cover on a cabinet for vertical swinging movement between horizontally disposed closed and vertically disposed open position, said mechanism including a first hinge part adapted to be attached to one of said cover and said cabinet, a second hinge part adapted to be attached to the other of said cover and said cabinet, hinge pin means for pivotally interconnecting said first and second hinge parts for relative vertical swinging movement, a counterbalance spring device having first and second ends, a first pivot means for connecting said first end to said first hinge part for pivotal movement relative thereto, and second pivot means for connecting said second end to said second hinge part for pivotal movement relative thereto, said spring device being adapted to exert a force tending to swing said cover vertically about said hinge pin means from said closed position toward said open position, the improvement for selectively disabling said spring device to permit disassembly of said first pivot means, which comprises in combination:

said first pivot means includes a bearing opening in said first end of said spring device, an enlarged bearing opening provided in said first hinge part and a pivot pin sized to be removably inserted within said bearing opening and said enlarged bearing opening, said enlarged bearing opening having a bearing end portion and a remote end portion spaced from said bearing end portion through a distance sufficient to permit displacement of said pivot pin from engagement with said bearing end portion, said enlarged bearing opening being positioned in said first hinge part such that said force exerted by said spring device tends to move said pivot pin in said enlarged bearing opening as required to normally maintain said pivot pin in bearing engagement with said bearing end portion;

said first end of said spring device is provided with a cam surface; and retaining means removably disposed for engagement by said cam surface and cooperation therewith for releasably retaining said spring device in a partially retracted condition and arranging said bearing opening of said first end in alignment with said enlarged bearing opening intermediate said bearing and remote end portions thereof.

2. The improvement according to claim 1, wherein said retaining means includes first and second openings formed in said second hinge part and first and second retaining pins sized to be removably received within said first and second openings, respectively, and said first and second openings are arranged to position said first and second retaining pins for engagement by said cam surface.

3. The improvement according to claim 2, wherein said first hinge part is adapted to be fixed to said cover, said second hinge part is adapted to be fixed to said cabinet, said bearing and remote end portions of said enlarged bearing opening are arranged relatively remotely from and adjacent to said hinge pin means, respectively, said cam surface is generally convex, and said cam surface successively engages said retaining pins to effect movement of said pivot pin lengthwise of said enlarged bearing opening from engagement with said bearing end portion thereof and generally towards said hinge pin means.

4. The improvement according to claim 3, wherein said spring device is a pressure cylinder having an end surface thereof serving to define said cam surface.

5. In a combination hinge and counterbalance mechanism for hingedly mounting a cover on a cabinet for vertical swinging movement between horizontally disposed closed and vertically disposed open position, said mechanism including a first hinge part adapted to be attached to said cover and a second hinge part adapted to be attached to said cabinet, hinge pin means for pivotally interconnecting said first and second hinge parts for relative vertical swinging movement, a counterbalance spring device having first and second ends, a first pivot mens for connecting said first end to said first hinge part for pivotal movement relative thereto, and second pivot means for connecting said second end to said second hinge part for pivotal movement relative thereto, said spring device being adapted to exert a force tending to swing said first hinge part vertically about said hinge pin means from a closed position toward an open position corresponding to said closed and open positions of said cover, respectively, the improvement for selectively disabling said spring device to permit disassembly of said first pivot means, which comprises in combination:

said first pivot means includes a bearing opening in said first end of said spring device, an enlarged bearing opening provided in said first hinge part and a pivot pin sized to be removably inserted within said bearing opening and said enlarged bearing opening, said enlarged bearing opening having a bearing end portion and a remote end portion spaced from said bearing end portion through a distance sufficient to permit displacement of said pivot pin from engagement with said bearing end portion, said enlarged bearing opening being positioned in said first hinge part such that said force exerted by said spring device tends to move said pivot pin in said enlarged bearing opening as required to normally maintain said pivot pin in bearing engagement with said bearing end portion;

said first end of said spring device is provided with a cam surface; and a pair of retaining pins are removably supported by said second hinge part in positions immediately above said cam surface when said first hinge part is in said closed position thereof for successive engagement by said cam surface incident to movement of said first hinge part away from said closed position thereof towards said open position thereof to effect deactivation of said spring device and movement of said pivot pin from engagement with said bearing end portion to permit disassembly of said first pivot means.

6. The improvement according to claim 5, wherein said bearing end portion and said remote end portion are disposed relatively remotely from and adjacent said hinge pin means, respectively, and successive engagement of said retaining pins by said cam surface moves said pivot pin from engagement with said bearing end portion in a direction generally towards said hinge pin means.

7. The improvement according to claim 6, wherein said cam surface is generally convex.

* * * * *

UNITED STATES PATENT AND TRADEMARK OFFICE

CERTIFICATE OF CORRECTION

PATENT NO. : 4,312,097

DATED : January 26, 1982

INVENTOR(S) : Kenneth J. Boyd

It is certified that error appears in the above-identified patent and that said Letters Patent are hereby corrected as shown below:

Col. 2, Line 51 - After "and/or", please insert --- as ---.

Col. 3, Line 53 - After "bearing", please delete "portion".

Col. 4, Line 30 - "as" should be --- at ---.

Col. 4, Line 38 - After "the", please insert --- cam surface will ---.

Col. 5, Line 28 - "portion" should be --- position ---.

Col. 6, Line 46 - "mens" should be --- means ---.

Signed and Sealed this

*Eleventh* Day of *May 1982*

[SEAL]

*Attest:*

GERALD J. MOSSINGHOFF

*Attesting Officer*

*Commissioner of Patents and Trademarks*